US008267731B2

(12) United States Patent
Arvidsson

(10) Patent No.: US 8,267,731 B2
(45) Date of Patent: Sep. 18, 2012

(54) BREAKAWAY SAFETY SYSTEM

(75) Inventor: Lennart Arvidsson, Kallered (SE)

(73) Assignee: AB Volvo Penta, Göteborg (SE)

( * ) Notice: Subject to any disclaimer, the term of this patent is extended or adjusted under 35 U.S.C. 154(b) by 242 days.

(21) Appl. No.: 12/812,478

(22) PCT Filed: Jan. 31, 2008

(86) PCT No.: PCT/SE2008/000088

§ 371 (c)(1),
(2), (4) Date: Jul. 12, 2010

(87) PCT Pub. No.: WO2009/096823

PCT Pub. Date: Aug. 6, 2009

(65) Prior Publication Data

US 2010/0291816 A1 Nov. 18, 2010

(51) Int. Cl.
*B63H 5/125* (2006.01)
*B63H 20/08* (2006.01)

(52) U.S. Cl. ..... 440/56

(58) Field of Classification Search ..... 440/1, 56
See application file for complete search history.

(56) References Cited

U.S. PATENT DOCUMENTS 2,124,497 A * 7/1938 Slauson ..... 114/219
2,917,019 A 12/1959 Kreuger
3,470,844 A 10/1969 Johns
4,734,065 A 3/1988 Nakahama et al.
5,238,432 A 8/1993 Renner
2006/0079140 A1 4/2006 Muller

FOREIGN PATENT DOCUMENTS

DE 2627953 A1 12/1977

OTHER PUBLICATIONS

International Search Report for corresponding International Application PCT/SE2008/000088, Oct. 2008.
International Preliminary Report on Patentability for corresponding International Aplication PCT/SE2008/000088, Jan. 2010.

* cited by examiner

*Primary Examiner* — Stephen Avila
*Assistant Examiner* — Anthony Wiest
(74) *Attorney, Agent, or Firm* — WRB-IP LLP

(57) ABSTRACT

There is provided a breakaway safety system for a vessel. The vessel includes: (a) a hull; (b) one or more engine arrangements supported by the hull; and (c) one or more propeller extensions mounted to the hull and coupled to receive motive power from the one or more engine arrangements in operation. The safety system includes: one or more sensors mounted to the vessel for measuring operating parameters of the vessel and generating one or more corresponding input signals; a control unit for receiving the one or more corresponding input signals, and for processing the one or more input signals to generate at least one control output; one or more fracturable regions for mounting the one or more propeller extensions to the at least one hull; and one or more fracturing devices operable to fracture the one or more fracturable regions for jettisoning associated one or more propeller extensions in an event that the control unit detects a potentially hazardous impact event and activates its at least one control output accordingly.

14 Claims, 7 Drawing Sheets

BREAKAWAY SAFETY SYSTEM

BACKGROUND AND SUMMARY

The present invention relates to breakaway safety systems for aquatic vessels, for example for boats, yachts and ships. Moreover, the present invention also concerns methods of protecting aquatic vessels from damage by using breakaway safety systems.

As illustrated in FIG. 1, there is shown an illustrative side view of a contemporary aquatic vessel indicated generally by 10. The aquatic vessel 10 is susceptible to being implemented, for example, as a yacht, ship or boat. The aquatic vessel 10 includes a hull 20. One or more engine assemblies 30 are mounted towards a rear end of the hull 20, wherein the one or more engine assemblies 30 are operable to provide motive power to propel the vessel 10 through water 40. Moreover, each of the one or more engine assemblies 30 include an extension 50 including one or more propellers 60 at substantially a distal end of the extension 50 remote from the hull 20. The extension 50 protrudes into the water 40 beneath the hull 20 when the aquatic vessel 10 is in operation. The one or more extensions 50 are potentially vulnerable regions of the vessel 10 in an event that the one or more extensions 50 impact onto submerged objects 70, for example submerged rocks, submerged harbour structures, ship wrecks and sunken components such as discarded oil rig components.

Contemporary yachts weigh in a range of 10 to 75 tonnes and are often equipped with two engine assemblies each delivering 250 kW output power or four engine assemblies each delivering 750 kW output power. Moreover, these contemporary yachts are operable to attain speeds in a range of 3 to 45 knots (circa 5 km/h to 80 km/h). In operation, these contemporary yachts are susceptible of having an operative kinetic energy approaching several MegaJoules. Such a large amount of kinetic energy focussed inappropriately in the aquatic vessel 10 is an impact situation is susceptible to causing considerable damage.

It is known to include sacrificial mechanical structures in the aquatic vessel which fracture in an emergency situation to try to prevent damage occurring to the hull 20 and a risk that the aquatic vessel 10 sinks in the water 40. However, these sacrificial structures, for example fractural "weak points" whereas stress is deliberately concentrated by design, are not optimal in that they do not appropriately protect the aquatic vessel in all sailing situations.

It is desirable to provide a breakaway safety system which better protects an aquatic vessel in an event of potential impact.

According to a first aspect of the invention, there is provided a breakaway safety system for a vessel, the vessel including (a) at least one hull;

(b) one or more engine arrangements supported by the at least one hull; and (c) one or more propeller extensions mounted to the at least one hull and coupled to receive motive power from the one or more engine arrangements in operation;

characterized in that the safety system includes:

one or more sensors mounted to the vessel for measuring operating parameters of the vessel and generating one or more corresponding input signals;

a control unit for receiving the one or more corresponding input signals, and for processing the one or more input signals to generate at least one control output (Q, A);

one or more fracturable regions for mounting the one or more propeller extensions to the at least one hull; and one or more fracturing devices operable to fracture the one or more fracturable regions for jettisoning associated one or more propeller extensions in an event that the control unit detects a potentially hazardous impact event and activates its at least one control output (Q, A) accordingly.

The invention is of advantage that use of the one or more fracturing devices to separate the one or more propeller extensions in a controlled manner is capable of improving safety and reducing the at least one hull from becoming damaged.

Optionally, in the breakaway safety system, the one or more fracturing devices each includes an energy storage element, a piercing element operable to fracture its associated fracturable region when impacting thereinto, and wherein the energy storage element when activated is operable to apply a force to the piercing element to force it into the fracturable region to cause the fracturable region to fracture. Use of the energy storage element is beneficial in jettisoning the one or more propeller extensions more rapidly from the at least one hull in comparison to relying on unassisted fracturing of the one or more propeller extensions from the hull in direct response to excessive applied stress as employed in contemporary known solutions.

More optionally, in the breakaway safety system, the energy storage element includes at least one of: an explosive charge, a mechanical spring, a volume of compressed gas. Use of such energy storage elements is capable of providing considerable immediate energy for jettisoning the one or more propeller extensions from the at least one hull.

More optionally, in the breakaway safety system, the control unit is provided with the input signals from one or more of:

(a) a strain sensor mounted on the at least one hull of the vessel;

(b) a strain sensor mounted at the one or more fracturable regions;

(c) an engine revolution rate sensor operable to measure a rate of rotation of one or more engine arrangement of the vessel;

(d) a speed sensor operable to measure a speed of the vessel through water;

(e) an accelerometer mounted to the vessel, or to the extension thereof, for measuring acceleration and/or deceleration thereof;

(f) a turning rate sensor for measuring changes in angular orientation on the vessel; (g) a gear engagement sensor for measuring engagement of one or more drive gears of the vessel; and (h) a sonar sensor for detecting a presence of one or more objects underneath, behind and/or in front of the vessel likely to present an impact hazard for the vessel when in operation. Any combination of these diverse sensors are susceptible to being employed depending on requirements.

Optionally, in the breakaway safety system, the control unit includes a data recorder for recording a sequence of the one or more input signals in a period prior to jettisoning the one or more propeller extensions from the hull. Use of such a data recorder is useful for determining whether or not the system has responded in an intended manner for avoiding damage to the at least one hull. Such information is relevant for insurance purposes for example.

Optionally, in the breakaway safety system, the fracturing device is operable to be disarmed when the vessel is in a stationary state in water, thereby preventing activation of the fracturing device when in the disarmed state. Such disarming of the piercing device is valuable for substantially preventing any risk of jettisoning one or more propeller extensions when the vessel is substantially stationary.

According to a second aspect of the invention, there is provided a method of providing a vessel with breakaway safety using a breakaway safety system, the vessel including (a) at least one hull;

(b) one or more engine arrangements supported by the at least one hull; and (c) one of more propeller extensions mounted to the at least one hull and coupled to receive motive power from the one or more engine arrangements in operation;

characterized in that the method includes steps of:

(d) mounting the one or more propeller extensions to the hull by one or more fracturable regions;

(e) arranging for one or more sensors mounted to the vessel to measure operating parameters of the vessel and to generate one or more corresponding input signals;

(f) arranging for a control unit to receive the one or more corresponding input signals, and to process the one or more input signals to generate at least one control output (Q, A); and (g) using one or more fracturing devices to fracture the one or more fracturable regions for jettisoning associated one or more propeller extensions in an event that the control unit detects a potentially hazardous impact event and activates its at least one control output (Q, A) accordingly.

Optionally, the method includes steps of:

(h) arranging for the one or more fracturing devices to each include an energy storage element, a piercing element operable to fracture its associated fracturable region when impacting thereinto; and (i) using the energy storage element when activated to apply a force to the piercing element to force it into the fracturable region to cause the fracturable region to fracture.

Optionally, when implementing the method, the energy storage element includes at least one of: an explosive charge, a mechanical spring, a volume of compressed gas.

Optionally, when implementing the method, the control unit is provided with the input signals from one or more of:

(a) a strain sensor mounted on the at least one hull of the vessel;

(b) a strain sensor mounted at the one or more fracturable regions; (c) an engine revolution rate sensor operable to measure a rate of rotation of one or more engine arrangements of the vessel;

(d) a speed sensor operable to measure a speed of the vessel through water;

(e) an accelerometer mounted to the vessel, or to the extension thereof, for measuring acceleration and/or deceleration thereof; (T) a turning rate sensor for measuring changes in angular orientation of the vessel or a portion thereof; (g) a gear engagement sensor for measuring engagement of one or more drive gears of the vessel; and (h) a sonar sensor for detecting a presence of one or more objects underneath, behind and/or in front of the vessel likely to present an impact hazard for the vessel when in operation.

Optionally, the method includes a step of:

(i) recording using a data recorder a sequence of the one or more input signals in a period prior to jettisoning the one or more propeller extensions from the at least one hull.

Optionally, the method includes a step of disarming the fracturing device when the vessel is in a stationary state in water, thereby preventing activation of the fracturing device when in the disarmed state.

According to a third aspect of the invention, there is provided a software product stored on data carrier, the software product being executable in computing hardware for implementing a method pursuant to the second aspect of the invention.

According to a fourth aspect of the invention, there is provided a method of protecting a hull of a vessel in an event of a potential impact, the vessel including one or more engine arrangements, and one of more propeller extensions coupled to the one or more engine arrangements for receiving motive power therefrom in operation, the method including steps of:

(a) detecting potential occurrence of an impact event which is susceptible to damaging the hull of the vessel; and (b) jettisoning the one or more propeller extensions when potential occurrence of an impact event is detected.

According to a fifth aspect of the present invention, there is provided an aquatic vessel equipped with a breakaway safety system pursuant to the first aspect of the invention.

Features of the invention are susceptible to being combined in any combination without departing from the scope of the invention as defined by the appended claims.

BRIEF DESCRIPTION OF THE DRAWINGS

Embodiments of the present invention will now be described, by way of example only, with reference to the following diagrams wherein.

DETAILED DESCRIPTION

In overview, the present invention is concerned with breakaway safety systems for use in aquatic vessels. The vessels each include one or more hulls wherein one or more of the hulls are equipped with one or more engine assemblies whose one or more propeller assemblies protrude in a region of water beneath the one or more hulls when the vessels are in operation. One or more propeller assemblies are coupled to their respective one or more hulls by corresponding one or more sacrificial breakable regions which is susceptible to being triggered from an intact state to a fractured state by control signals generated in expectation of an impact event, thereby preventing the one or more hulls being stressed as occurs with contemporary known safety breakaway systems. Moreover, the present invention is of benefit in that the one or more propeller assemblies are capable of not being jettisoned unnecessarily, thereby saving repair costs.

The present invention is distinguished in that pre-stored energy is released in a controlled manner and at an appropriate time and situation to fracture a mechanical connection between a propeller assembly and its associated engine assembly for jettisoning the propeller assembly. The pre-stored energy can be derived for an explosive pyrotechnics component, from a compressed gas chamber or any other type of energy storage element operable to generate a mechanical force of sufficient magnitude to fracture the mechanical connection. By employing such a breakaway system, the propeller assembly is susceptible to being jettisoned from its engine assembly and associated hull potentially within milliseconds within the engine assembly and its hull being stressed, thereby averting any damage from occurring thereto.

The pre-stored energy is susceptible to being released in response to a control signal output Q from a control unit changing from an inactive state to an active state. The control unit is coupled to one or more sensors which are operable to measure various parameters in their associated aquatic vessel, In an event that certain conditions arise is respect of the various parameters as detected by the control unit, the control unit is operable to switch its aforesaid control signal output from the inactive state to the active state. The control unit is beneficially implemented in analogue electronic circuits, digital electronic circuits and/or computing hardware operable to execute a software product recorded on a data carrier. The data carrier is optionally non-volatile solid state memory or a magnetic or optical data recording medium.

Figure 1:
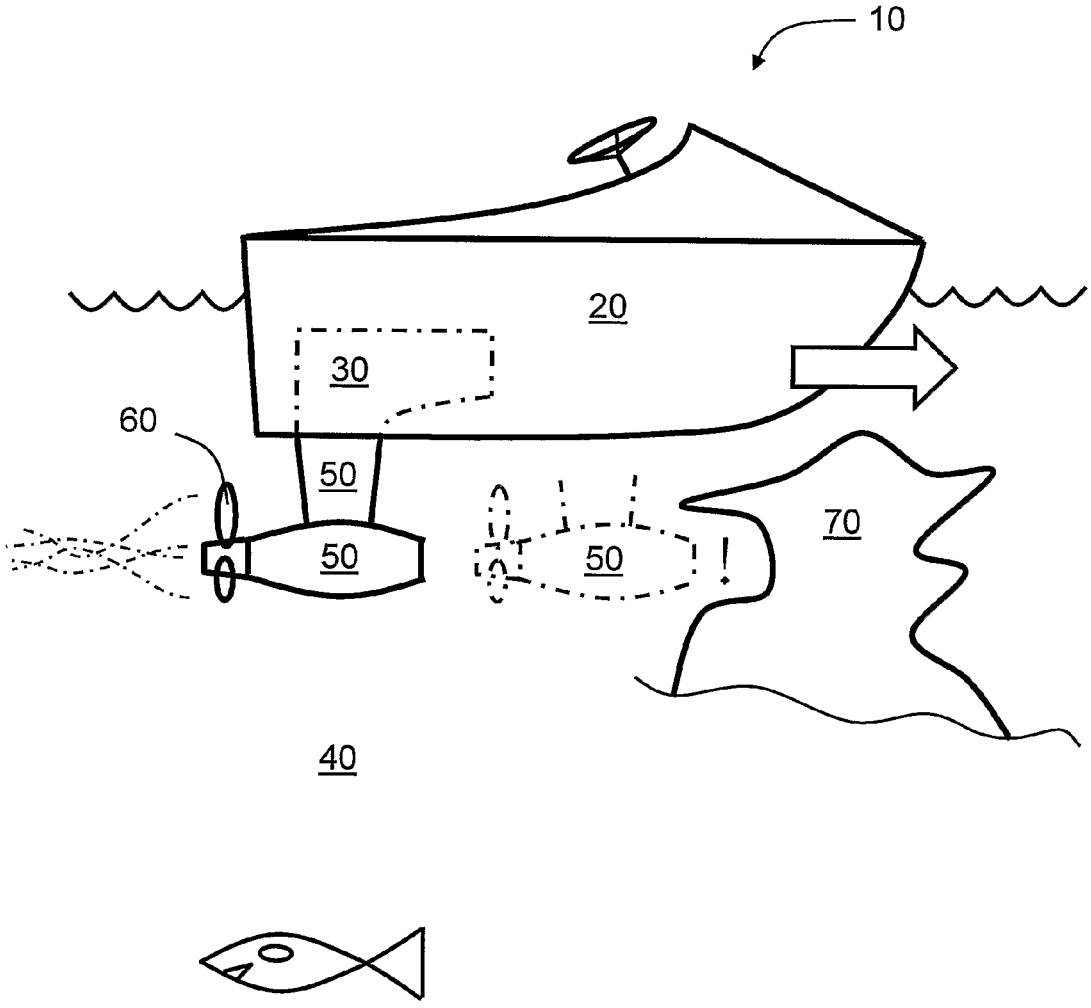
FIG. 1 is a side view illustration of an aquatic vessel in water and in motion towards an impact with a submerged object.
Figure 2:
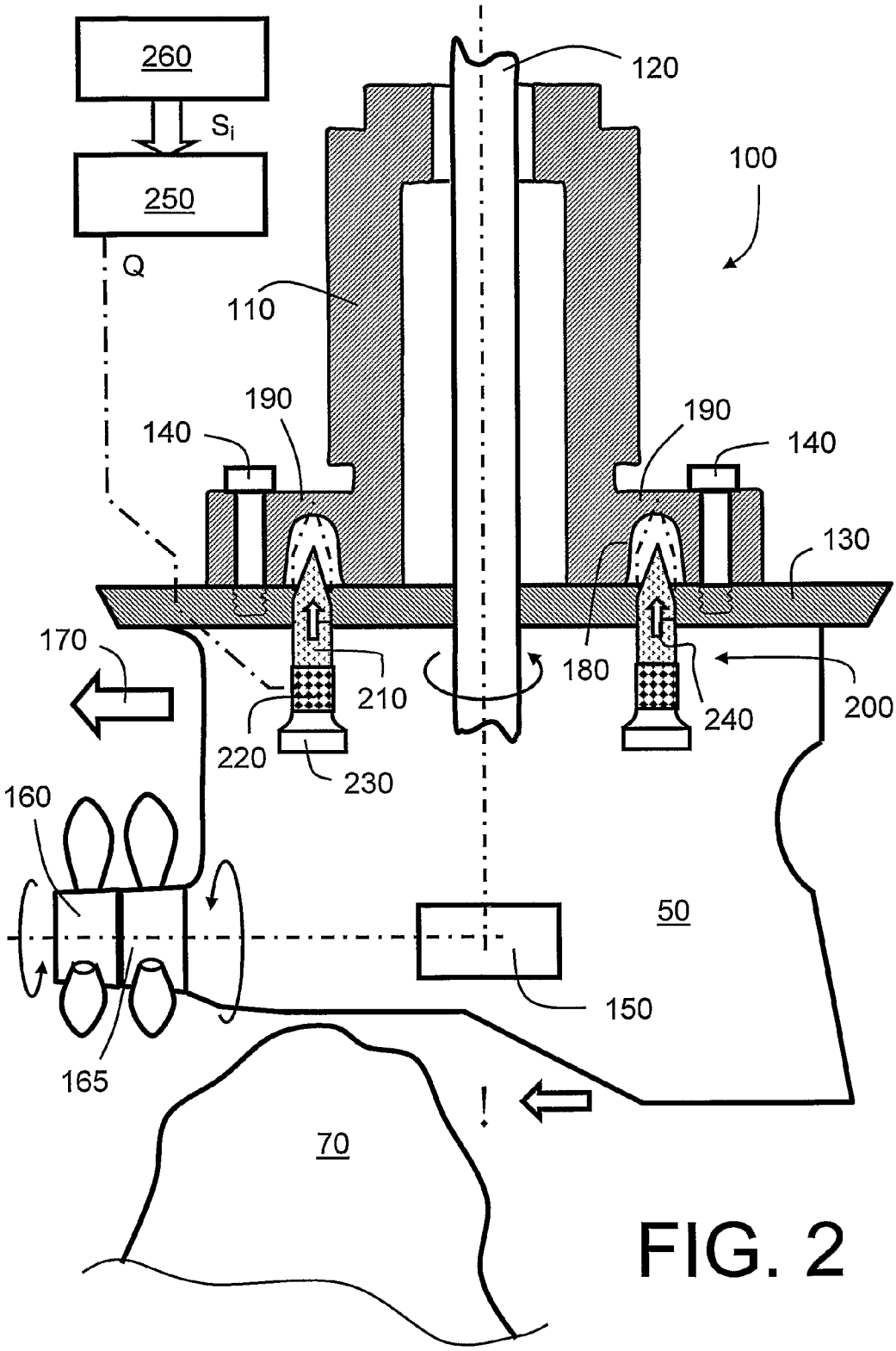
FIG. 2 is an illustration of a breakaway safety system pursuant to the present invention, the system employing a pyrotechnic piercing device as a piercing energy storage element.

Referring to FIG. 2, there is shown an illustration of a safety breakaway system in the aquatic vessel 10; the safety breakaway system is indicated generally by 100. The vessel 10 includes an engine transmission housing 110 into which is accommodated a transmission shaft 120 which is operable to rotate relative to the transmission housing 110 to deliver mechanical propulsion power in use. The transmission housing 110 is attached by way of fasteners 140, for example threaded bolts, to a mounting plate 130 of the aforementioned extension 50. The extension 50 beneficially includes a wing member as illustrated formed in a manner of a vane. Moreover, a transmission unit 150 is included at distal end of the extension 50 for coupling power delivered via the transmission shaft 120 to clockwise and anticlockwise rotations for driving a pair of mutually counter-rotating propellers 160, 165 implemented to pull the vessel 10 through the water 40 in a tractor manner in a direction denoted by an arrow 170.

The transmission housing 110, namely a part of a suspension structure of the vessel 10, includes a rounded annular recess 180 defining a relative thin annular fracture region 190. In close vicinity to the annular recess 180 are positioned one of more fracture initiating devices indicated generally by 200. Each fracture initiating device 200 includes a pointed piercing element 210, an energy storage element 220 spatially behind the piercing element 210, and a detonator 230 adjacent to the energy storage element 220. Optionally, the energy storage element 220 is an explosive pyrotechnics device operable when detonated to force, as denoted by an arrow 240, the piercing element 210 into an end surface of the rounded annular recess 180 to cause the annular fracture region 190 to fracture. The transmission shaft 120 is disconnectably enmeshed into the transmission unit 150 so that the extension 50 is capable of being jettisoned in an event of potential impact with the submerged object 70.

Fracturing the annular fracture region 190 in anticipation of an impact with the submerged object 70, or alternatively at an early phase of impact onto the object 70, enables stress being applied to the hull 20 to be reduced, thereby protecting the hull 20 which is potentially a high proportion of total value of the vessel 10.

As shown in FIG. 2, the fracture initiating device 200 is coupled to a control unit 250 which, in turn, is connected to receive signals from one or more sensors denoted by 260. The control unit 250 is operable to continuously monitor signals provided by the one or more sensors 260 and detonate or otherwise activate the one or more fracture initiating devices 200 in an event that the signals indicate that an impact is imminent or in a process of occurring. Operation of the control unit 250 will be elucidated in greater detail later.

The fracture initiating device 200 is susceptible to being implemented in several different ways. When it is implemented as a pyrotechnics device, a very considerable amount of energy is susceptible to being substantially immediately release from the energy storage element 220 to propel the pointed piercing element 210 to fracture the annular fracture region 190. However, pyrotechnics devices, in a manner akin to air-bags in vehicles, are potentially susceptible to exploding spontaneously if their explosive charge deteriorates; however, when contemporary pyrotechnics materials are employed, a risk of such spontaneous detonation is relatively low.

For enhancing safety, the control unit 250 is operable to monitor whether or not one or more engine assemblies 30 of the vessel 10 are actively in operation, namely supplied with fuel with their internal parts rotating. In an event that the one or more engine assemblies 30 are inactive, the fracture initiating device 200 is beneficially is switched to its disarmed state, for example by way of a disarming signal A issued from the control unit 250. Conversely, when the one or more engine assemblies 30 are activated, the fracture initiating device 200 is armed so as to be able to release its energy in an event that the control signal Q from the control unit 250 indicates that the propeller assembly 50 is to be jettisoned.

Figure 3:
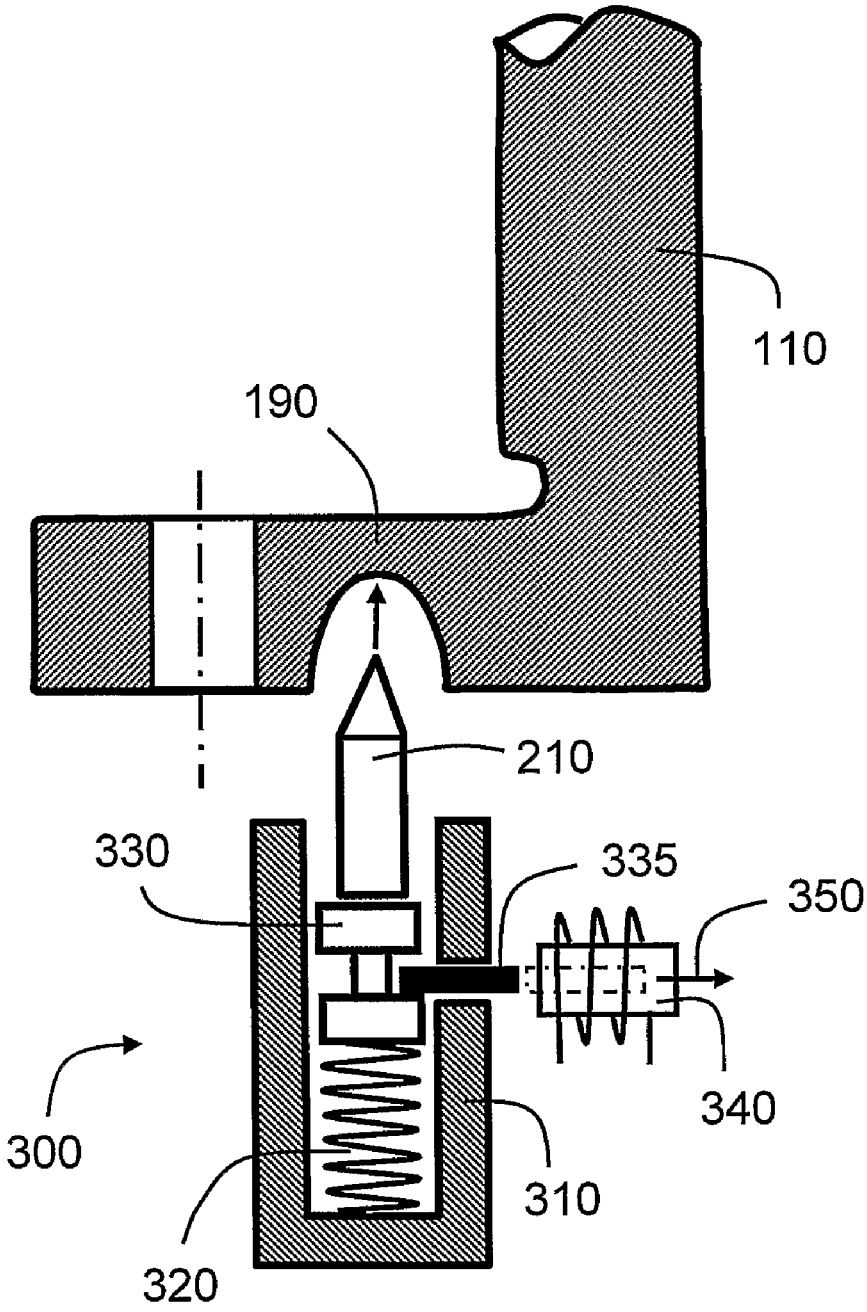
FIG. 3 is an illustration of a second alternative implementation of a piercing device for use in the system of FIG. 2, the device employing a linear spring as a piercing energy storage element.

A first alternative implementation of the fracture initiating device 200 is illustrated in FIG. 3; the alternative fracture initiating device is indicated generally by 300. The fracture initiating device 300 is shown in its non-deployed state. Moreover, the fracture initiating device 300 includes a robust mechanical housing 310 including a compressed helical spring 320 as an energy storage device. The compressed spring 320 includes a first end thereof abutting onto an end face of the robust housing 310, and a second end thereof abutting onto a rear face of hammer component 330. This hammer component 330 includes a waist region into which a retaining pin 335 is engaged to prevent the hammer component 330 being ejected from the robust housing 310. Moreover, the hammer component 330 includes an impact plate for impacting in operation onto a rear end of the pointed piercing element 210 when the fracture initiating device 300 is deployed.

The retaining pin 335 is coupled to an actuator 340, for example an electro-magnetic solenoid actuator, which is energized by way of the signal Q when the device 300 is to be deployed. In operation, during deployment to protect the hull 20, the control unit 250 energized the actuator 340 to cause the retaining pin 335 to be retracted laterally as denoted by an arrow 350 to enable the spring 320 to accelerate the hammer component 330 to impact onto the piercing element 200 to cause. In turn, the piercing element 200 to fracture the annular fracture region 190. It will be appreciated that the fracture initiating devices 200, 300 employ linearly-acting energy storage arrangements for forcing the piercing element 210 to fracture the fracture region 190.

Figure 4:
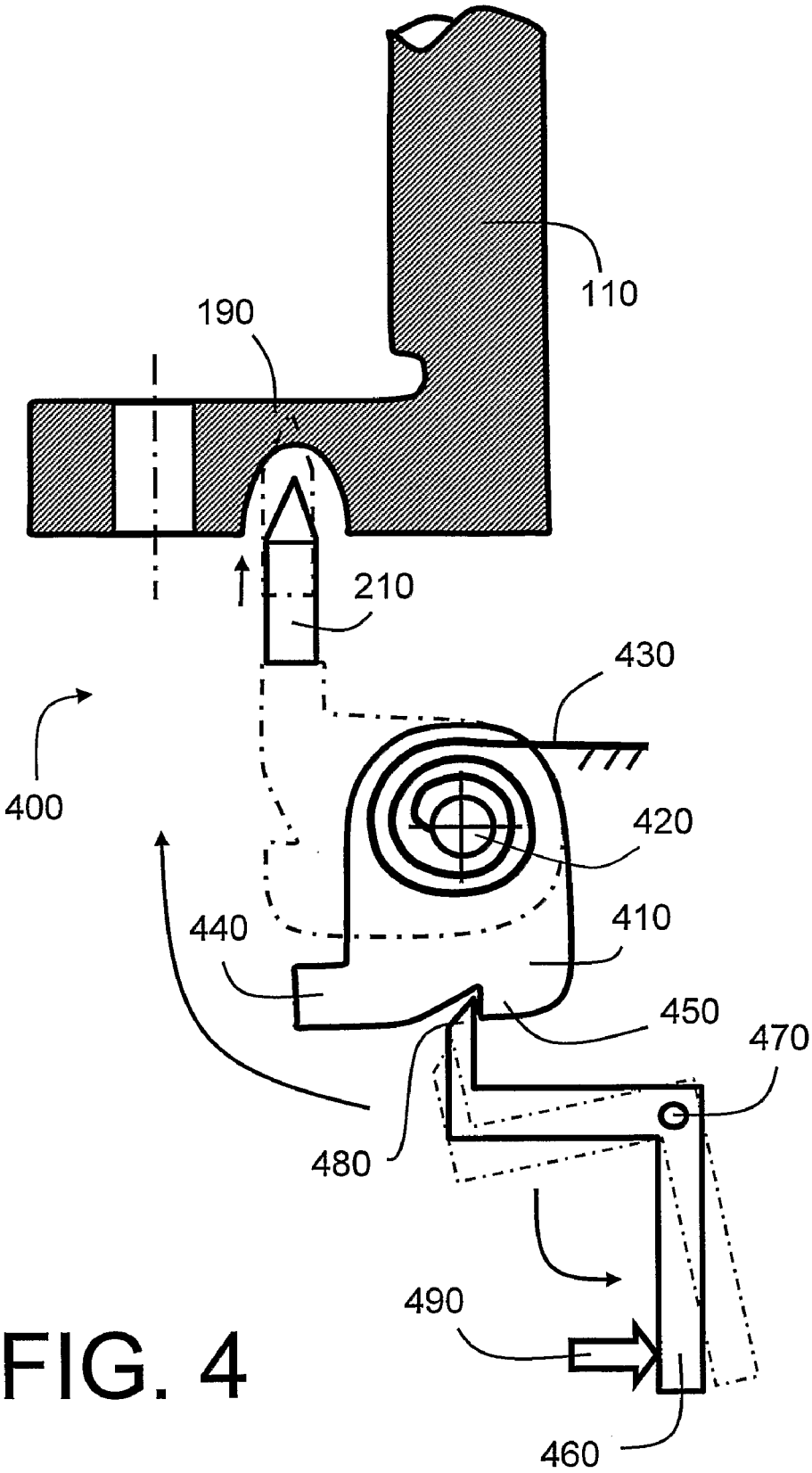
FIG. 4 is an illustration of a third alternative implementation of a piercing device for use in the system of FIG. 2, the device employing a rotary hammer arrangement with a spring as a piercing energy storage element.

A further alternative implementation of the fracture initiating device 200 is illustrated in FIG. 4; the alternative fracture initiating device is indicated generally by 400. The fracture initiating device 400 includes a hammer component 410 which is rotatably mounted at a pivot 420. Moreover, the hammer component 410 is furnished with a spiral spring 430 which functions in operation as a mechanical energy storage component. The hammer component 410 includes a hammer surface adapted to impact upon the rear end of the pointed piercing component 210 when the fracture initiating device 400 is deployed in operation. The device 400 includes a retaining portion provided with an indented notch comprising an abrupt edge.

Furthermore, the hammer component 410 includes an L-shaped release member 460 also arranged to rotate substantially at a central portion thereof about a pivot 470 in operation.

When the device 400 is in its non-deployed state, a retaining edge 480 at a first remote end of the release member 460 is engaged into the aforementioned indented notch to prevent the hammer component 410 rotating in response to rotational force applied thereby by the spiral spring 430.

When a force is applied to a second remote end of the release member 460 as illustrated, for example the force being provided from an electromagnetic actuator controlled via the output Q from the control unit 250, the release member 460 is forced to rotate about its pivot 470 and thereby causes the retaining edge 480 to disengage with the indented notch. As a result, the spiral spring 430 rotationally accelerates the hammer component 410 to impact onto the pointed piercing element 210. The piercing element 210 is, in turn, forced into the annular fracture region 190 causing the region 190 to fracture, thereby enabling the extension 50 to be safely jettisoned.

Figure 5:
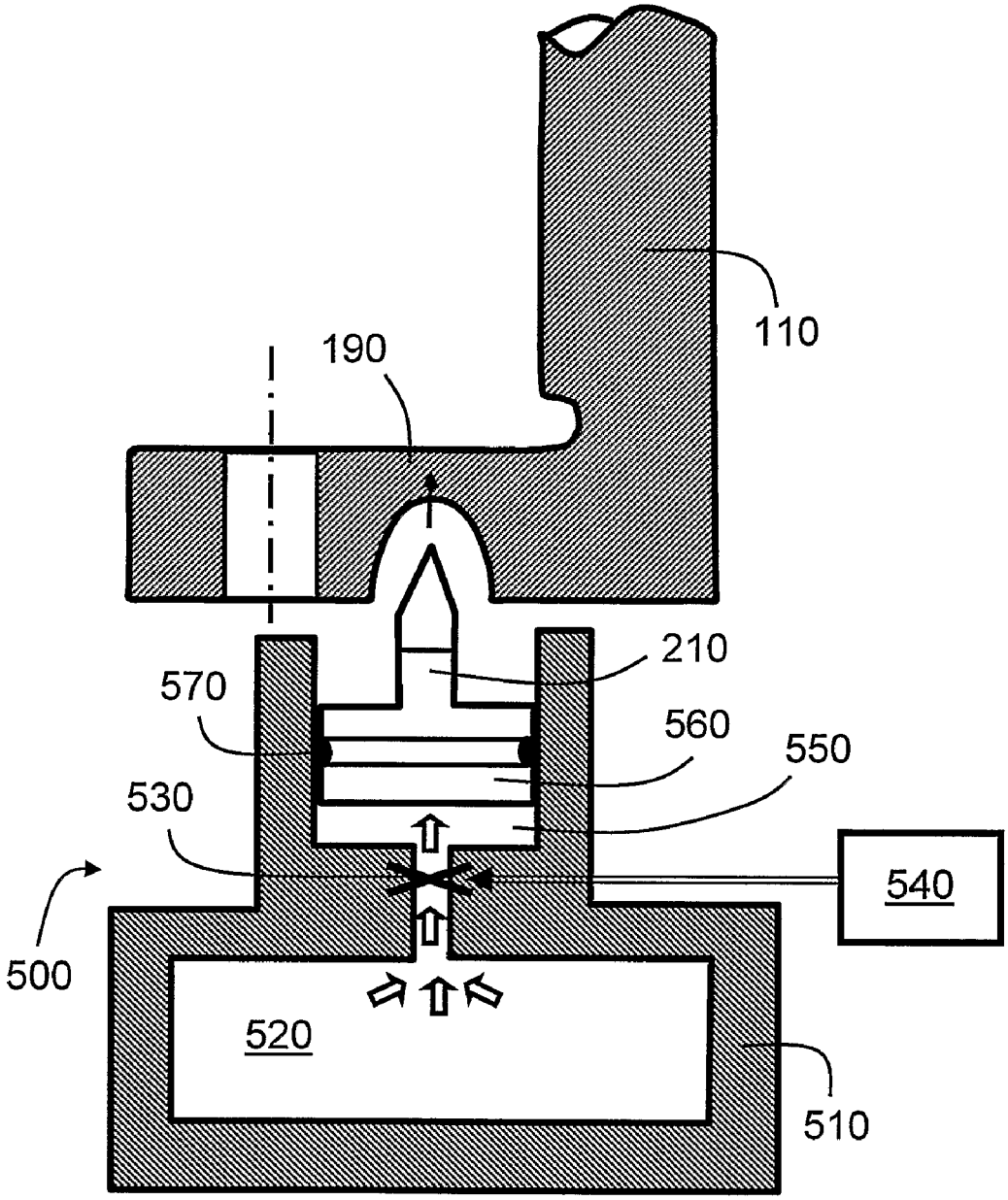
FIG. 5 is an illustration of a fourth alternative implementation of a piercing device for use in the system of FIG. 2, the device employing a pressurized gas cavity as a piercing energy storage element.

A yet further alternative implementation of the fracture initiating device 200 is illustrated in FIG. 5; the alternative fracture initiating device is indicated generally by 500. The device 500 includes a robust housing 510 having a cavity 520 therein filled with a gas at high pressure, for example in a range of 50 to 100 Bar. The robust housing 510 includes a valve 530, for example a needle valve, included within a venting tube linking the cavity 520 to a piston chamber 550; the valve 530 is coupled to an actuator 540 which is operable to receive the signal Q and to control release of the valve 530. When the device 500 is in its non-deployed state, the valve 530 is in a closed state to prevent loss of gas from the chamber 520. Moreover, the piercing element 210 is provided with a piston member 560 provided with an annual flexible seal 570 for ensuring a gas-tight seal to inside walls of the of the piston chamber 550.

In operation, when the control unit 250 detects that an impact event is imminent or commenced, the control unit 250 switches a state of its output Q from an inactive state to an active state to cause the actuator 540 to release the valve 530 to allow pressurized gas within the cavity 520 into the piston chamber 550 to propel the piercing element 210 into the fracture region 190 to jettison the extension 50 from the hull 20. A separation is beneficially provided between a pointed tip of the piercing element 210 and an impact surface of the fracture region 190 so that the piercing element 210 is accelerated before it impacts, thereby providing greater fracturing force to the piercing element 210.

The control unit 250 will now be described in greater detail with reference to FIG. 6. Beneficially, the control unit 250 is coupled to a data-bus of the vessel 10, for example to a CAN data-bus; when such a CAN data-bus is provided in the vessel 10, the control unit 250 is able to receive signal data which is conveyed via this data-bus. However, implementation of the present invention is not dependent upon the provision of such a data-bus within the vessel 10. Beneficially, the control unit 250 includes a data recorder, for example in a manner of a "black box" data recorder, for enabling signal characteristics leading up to jettisoning of the extension 50 to be retrospectively analysed, for example for insurance purposes.

The one or more sensors 260 beneficially include one or more of:

(a) one or more strain gauges mounted at the fracture region 190; the one or more strain gauges are operable to generate signals indicative of this region 190 suddenly suffering high strain as a consequence of sudden stress being applied thereto;

(b) one or more accelerometers mounted onto the vessel 10, for example onto the extension 50, to measure sudden accelerations applied thereto, for example indicative of an impact event;

(c) one or more turning rate sensors, for example one or more solid state micromachined gyroscopes and/or small optical gyroscopes, mounted onto the vessel 10, for example onto the extension 50, for measuring sudden changes in angular orientation of the extension 50 or the hull 20 indicative of an impact event;

(d) an engine revolution rate (RPM) sensor for measuring a revolution rate of an engine arrangement 30, for example for determining whether or not an engine arrangement 30 is revolving at a rate higher than a certain threshold rate;

(e) a sensor for detecting a sudden deceleration or acceleration of the hull 20, the extension 50 or the vessel 10 in general being above a defined threshold, for example as determined by strain gauges mounted at one or more locations onto the hull 20; (T) a sensor for sensing a speed of the vessel 10 through water 40; for example for determining whether or not the vessel 10 has exceeded a threshold speed; and (g) a sonar sensing system for detecting submerged objects beneath or in water along a path in which the vessel 10 is travelling.

The algorithm F is optionally operable to activate its output Q on a combination of parameters (a) to (f) being simultaneously satisfied. For example, the vessel 10 is potentially more likely to suffer damage at a relatively lower speed in a harbour when its extension 50 impacts onto a submerged structure in the harbour than at high speed when the running onto a sandbank when considerable flow of water accompanies motion of the vessel 10. The breakaway safety system is also operable to protect one or more persons on board the vessel 10 which be susceptible to being thrown overboard in a situation that the vessel 10 is suddenly decelerated as a result of one or more of its extensions 50 impacting onto one or more submerged objects.

Figure 6:
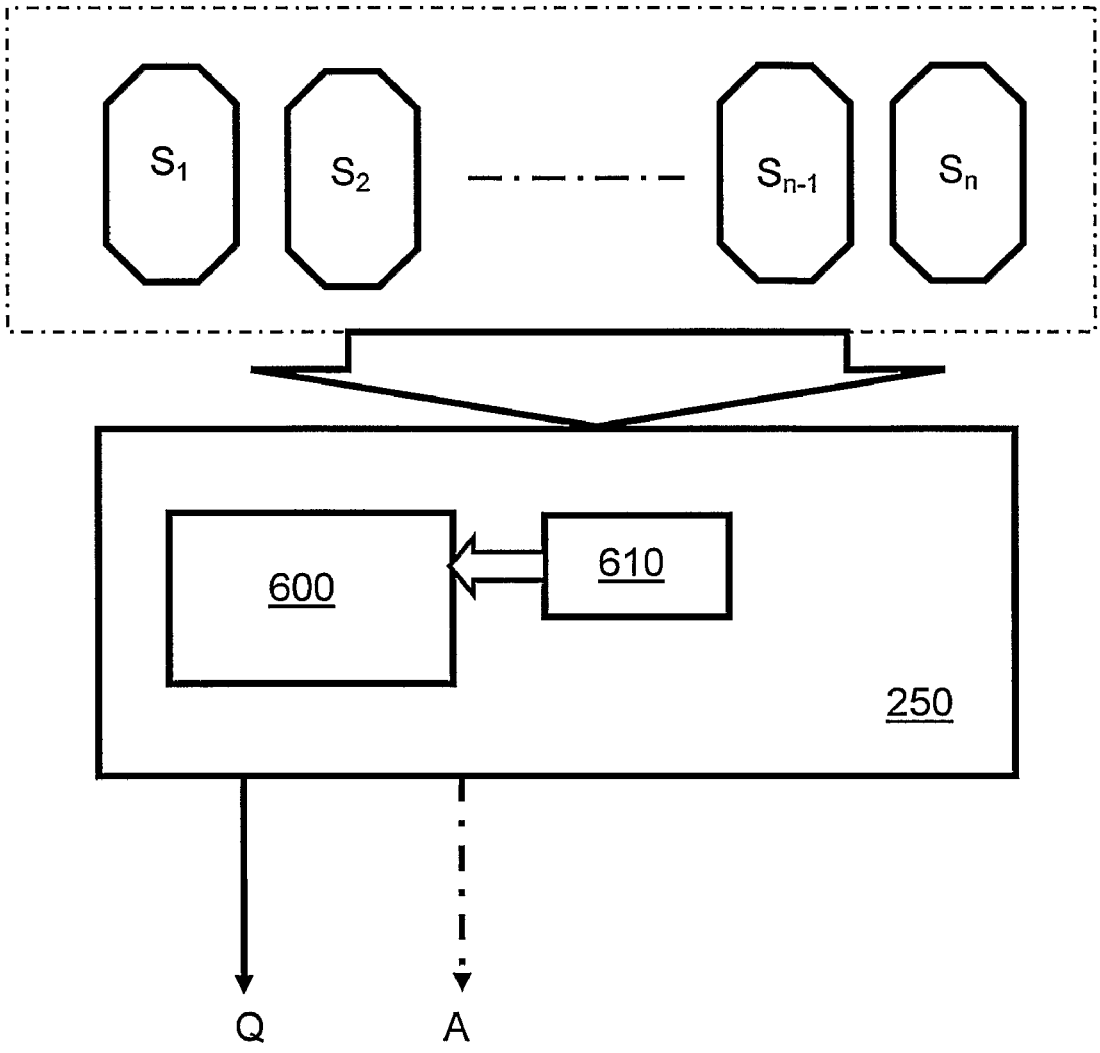
FIG. 6 is an illustration of a control unit coupled to associated sensors for implementing the system of FIG. 2.

In FIG. 6, the control unit 250 includes a processor 600 coupled to a data memory 610 including one or more executable software products. The one or more software products are downloadable to the data memory 610 via a physical data carrier such as a plug-in read only memory (ROM) and/or via a signal coupled to the control unit 250, wherein the signal is operable to function as a data carrier. Beneficially, one or more software products in the data-memory 610 are thereby susceptible to being updated.

The aforesaid one or more software products executed within the processor 600 are operable to implement an algorithm corresponding to a method of processing signals provided from n sensors denoted by S1 to Sn constituting the one or more sensors 260; n is an integer of value unity or greater. Moreover, the aforementioned outputs Q, A are generated by the control unit as an output of executing the one or more software products upon the processor 600.

Figure 7:
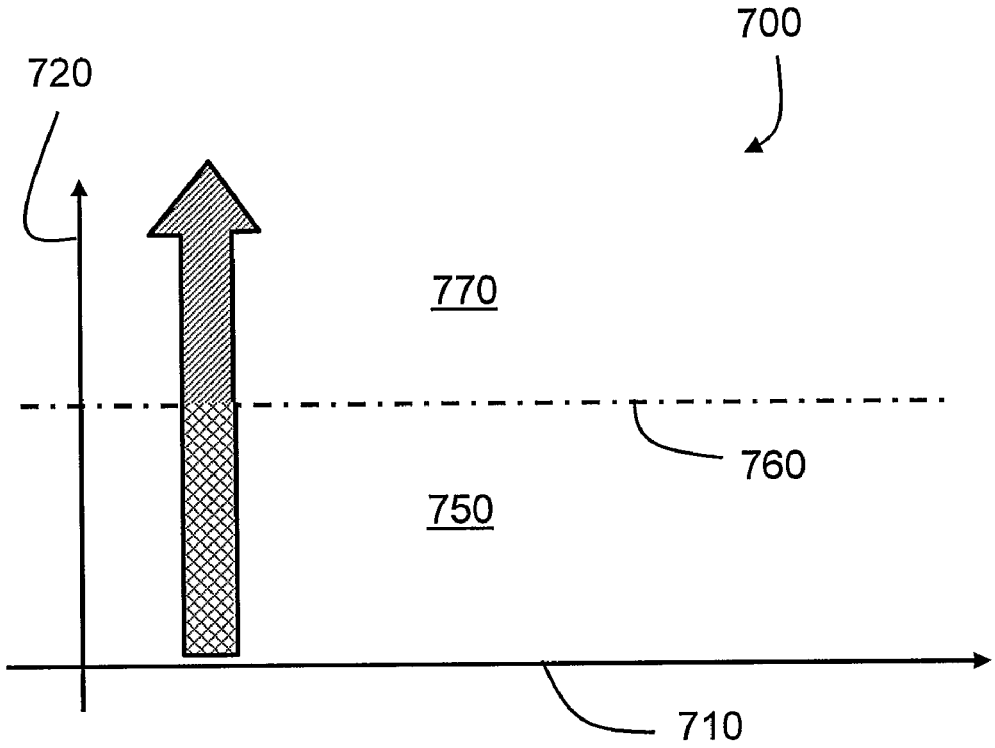
FIG. 7 is a schematic illustration of a detection threshold for use when triggering the system shown in FIG. 2.
Figure 7:
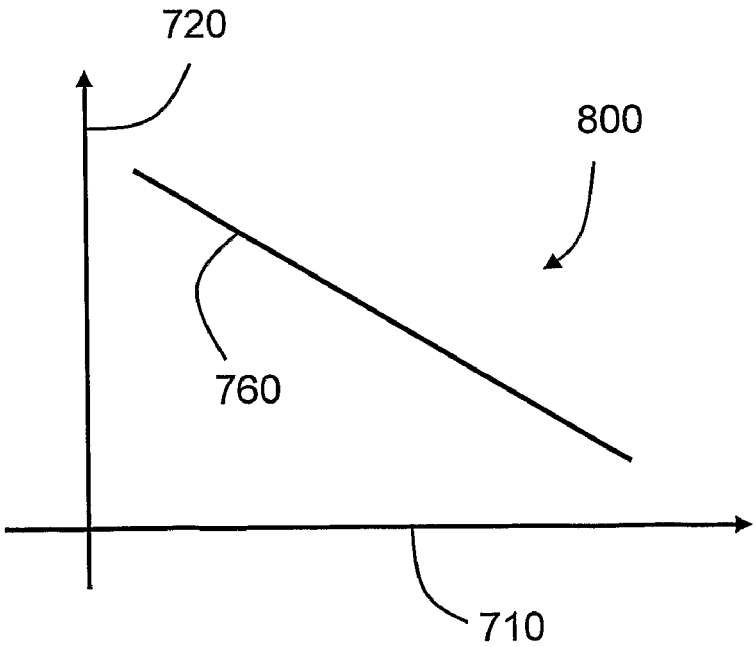

A schematic illustrative graph is shown in FIG. 7 to elucidate operation of the one or more software products. An abscissa axis 710 represents a speed of the vessel 10, either forwards or reverse. Moreover, an ordinate axis 720 represents whether or not the fracture initiating device 200, or alternative implementation thereof, is to be activated or not, namely a representation of the signal Q. A threshold 760 determines a state of the signal Q as described by Equations 1 and 2 (Eqs. 1 and 2):

$$H=F(S_1, \ldots, S_n) \quad \text{Eq. 1}$$

wherein $$Q=1 \text{ when } H>Th, \text{ and } Q=0 \text{ when } H<Th \quad \text{Eq. 2}$$

and wherein

F=an algorithm data processing function;

Th=a threshold determining activation of the piercing device; and

H=an Intermediate parameter.

Optionally, the threshold Th is a function of a speed of the vessel 10 as indicated by 800 such that the extension 50 is more readily jettisoned when the vessel 10 is travelling at high speeds to prevent damage occurring to the hull 20. As elucidated in the foregoing, the algorithm implemented in the processor 600 is operable to set the output signal A to a disarmed state, when relevant to the implementation of the piercing device 200 and its alternative implementations, when the vessel 10 is stationary, namely not having any of forward or reverse gears engaged in the vessel 10.

The algorithm F is optionally operable to activate the output Q in an event that any one of several criteria are satisfied as follows:

(a) the system has passed its start-up checks in an event that the vessel 10 is stationary, namely without its one or more gears being engaged; if a fault is detected, a warning is sent to a driver of the vessel 10 indicative that an abnormality has arisen; the driver then has a choice whether to override the breakaway safety system and sail off, or to investigate a cause of potential malfunction; such malfunction can occur because of failure of one of the sensors 260; and (b) the signals provided from the sensors S1 to Sn indicate that a impact event is imminent or is commencing.

In one example implementation of the breakaway safety system, the piercing device 200 is only activated provided that the engine arrangement 30 of the vessel 10 is running, the vessel 10 is engaged in gear for coupling propulsion to its one or more propellers, and the engine arrangement has an RPM rate exceeding a threshold, for example 1200 RPM. "RPM" is an abbreviation for revolutions per minute.

Optionally, the propeller extension 50 is provided with one or more features which enabled it to be located when jettisoned from the vessel 10 in operation. The one or more features include: (a) a sonar location module which is operable to transmit a sonar signal once the propeller extension 50 is jettisoned; and (b) a location buoy, for example implemented as a flexible inflatable gas-tight material which is deployed after the propeller extension has been jettisoned.

Expressions such as "has", "is", "include", "comprise", "consist of", "incorporates" are to be construed to include additional components or items which are not specifically defined; namely, such terms are to be construed in a non-exclusive manner. Moreover, reference to the singular is also to be construed to also include the plural. Furthermore, numerals and other symbols included within parentheses in the accompanying claims are not to be construed to influence interpreted claim scope but merely assist in understanding the present invention when studying the claims.

Modifications to embodiments of the invention described in the foregoing are susceptible to being implemented without departing from the scope of the invention as defined by the appended claims.

The invention claimed is:

1. A breakaway safety system for a vessel, the vessel including (a) at least one hull;

(b) one or more engine arrangements supported by the at least one hull; and (c) one of more propeller extensions mounted to the at least one hull and coupled to receive motive power from the one or more engine arrangements in operation;

the safety system including:

one or more sensors mounted to the vessel for measuring operating parameters of the vessel and for generating one or more corresponding input signals;

a control unit for receiving the one or more corresponding input signals, and for processing the one or more input signals to generate at least one control output;

one or more fracturable regions for mounting the one or more propeller extensions to the at least one hull; and one or more fracturing devices operable to fracture the one or more fracturable regions for jettisoning associated one or more propeller extensions in an event that the control unit detects a potentially hazardous impact event and activates its at least one control output accordingly.

2. A breakaway safety system as claimed in claim 1, wherein the one or more fracturing devices each includes an energy storage element, a piercing element operable to fracture its associated fracturable region when impacting thereinto, and wherein the energy storage element when activated is operable to apply a force to the piercing element to force it into the fracturable region to cause the fracturable region to fracture.

3. A breakaway safety system as claimed in claim 2, wherein the energy storage element includes at least one of: an explosive charge, a mechanical spring, a volume of compressed gas.

4. A breakaway safety system as claimed in claim 1, where the control unit is provided with the input signals from one or more of:

(a) a strain sensor mounted on the at least one hull of the vessel;

(b) a strain sensor mounted at the one or more fracturable regions;

(c) an engine revolution rate sensor operable to measure a rate of rotation of one or more engine arrangement of the vessel;

(d) a speed sensor operable to measure a speed of the vessel through water;

(e) an accelerometer mounted to the vessel, or to the extension thereof, for measuring acceleration and/or deceleration thereof;

(f) a turning rate sensor for measuring changes in angular orientation on the vessel;

(g) a gear engagement sensor for measuring engagement of one or more drive gears of the vessel; and (h) a sonar sensor for detecting a presence of one or more objects underneath, behind and/or in front of the vessel likely to present an impact hazard for the vessel when in operation.

5. A breakaway safety system as claimed in claim 1, wherein the control unit includes a data recorder for recording a sequence of the one or more input signals in a period prior to jettisoning the one or more propeller extensions from the hull.

6. A breakaway safety system as claimed in claim 1, wherein the fracturing device is operable to be disarmed when the vessel is in a stationary state in water, thereby preventing activation of the fracturing device when in the disarmed state.

7. A method of providing a vessel with breakaway safety using a breakaway safety system, the vessel including (a) at least one hull;

(b) one or more engine arrangements supported by the at least one hull; and (c) one of more propeller extensions mounted to the at least one hull and coupled to receive motive power from the one or more engine arrangements in operation;

the method comprising:

mounting the one or more propeller extensions to the hull by one or more fracturable regions;

arranging for one or more sensors mounted to the vessel to measure operating parameters of the vessel and to generate one or more corresponding input signals;

arranging for a control unit to receive the one or more corresponding input signals, and to process the one or more input signals to generate at least one control output; and using one or more fracturing devices to fracture the one or more fracturable regions for jettisoning associated one or more propeller extensions in an event that the control unit detects a potentially hazardous impact event and activates its at least one control output accordingly.

8. A method as claimed in claim 7, including steps of:

arranging for the one or more fracturing devices to each include an energy storage element, a piercing element operable to fracture its associated fracturable region when impacting thereinto; and using the energy storage element when activated to apply a force to the piercing element to force it into the fracturable region to cause the fracturable region to fracture.

9. A method as claimed in claim 8, wherein the energy storage element includes at least one of: an explosive charge, a mechanical spring, a volume of compressed gas.

10. A method as claimed in claim 7, wherein the control unit is provided with the input signals from one or more of:

(a) a strain sensor mounted on the at least one hull of the vessel;

(b) a strain sensor mounted at the one or more fracturable regions;

(c) an engine revolution rate sensor operable to measure a rate of rotation of one or more engine arrangements of the vessel;

(d) a speed sensor operable to measure a speed of the vessel through water;

(e) an accelerometer mounted to the vessel, or to the extension thereof, for measuring acceleration and/or deceleration thereof;

(f) a turning rate sensor for measuring changes in angular orientation of the vessel or a portion thereof;

(g) a gear engagement sensor for measuring engagement of one or more drive gears of the vessel; and (h) a sonar sensor for detecting a presence of one or more objects underneath, behind and/or in front of the vessel likely to present an impact hazard for the vessel when in operation.

11. A method as claimed in claim 7, including a step of:

recording using a data recorder a sequence of the one or more input signals in a period prior to jettisoning the one or more propeller extensions from the at least one hull.

12. A method as claimed in claim 7, wherein the method includes a step of disarming the fracturing device when the vessel is in a stationary state in water, thereby preventing activation of the fracturing device when in the disarmed state.

13. A software product stored on data carrier, the software product being executable in computing hardware for implementing a method as claimed in claim 7.

14. An aquatic vessel equipped with a breakaway safety system as claimed in claim 1.

* * * * *